US007213592B2

(12) United States Patent
Fischhaber et al.

(10) Patent No.: US 7,213,592 B2
(45) Date of Patent: May 8, 2007

(54) SUSPENSION OR RACK FRAME FOR APPARATUS FOR THE HEAT TREATMENT OF SUBSTANCES, ESPECIALLY FOODSTUFFS

(75) Inventors: Herbert Fischhaber, Hohenpeissenberg (DE); Lutz Riefenstein, Weilheim i.OB (DE); Dario Manicardi, Carpi (IT); Giovanni Allesina, Carpi (IT)

(73) Assignees: Convotherm Elektrogerate GmbH, Eglfing (DE); Angelo Po Grandi Cucine S.p.A., Capri (IT)

( * ) Notice: Subject to any disclaimer, the term of this patent is extended or adjusted under 35 U.S.C. 154(b) by 663 days.

(21) Appl. No.: 10/324,203

(22) Filed: Dec. 20, 2002

(65) Prior Publication Data

US 2003/0116032 A1 Jun. 26, 2003

(30) Foreign Application Priority Data

Dec. 21, 2001 (DE) ..... 101 63 285

(51) Int. Cl.
*F24C 15/16* (2006.01)

(52) U.S. Cl. ..... 126/337 R; 211/71.01

(58) Field of Classification Search ..... 126/337 R, 126/339, 333; 99/450; 312/410; 211/181.1, 211/153, 71.01, 126.1
See application file for complete search history.

(56) References Cited

U.S. PATENT DOCUMENTS

| | | | | |
|---|---|---|---|---|
| 1,851,192 | A * | 3/1932 | Lange | 126/339 |
| 1,989,275 | A * | 1/1935 | Hatch | 312/408 |
| 2,225,762 | A * | 12/1940 | Barnsteiner | 211/162 |
| 2,574,950 | A * | 11/1951 | Ben-Dor | 126/339 |
| 2,671,004 | A * | 3/1954 | Chadwick et al. | 126/337 R |
| 2,742,559 | A * | 4/1956 | Edelman | 126/339 |

FOREIGN PATENT DOCUMENTS

| | | | |
|---|---|---|---|
| DE | 35 05 807 | A1 * | 8/1986 |
| EP | 1 260 770 | A1 * | 5/2002 |

* cited by examiner

*Primary Examiner*—Josiah C. Cocks
(74) *Attorney, Agent, or Firm*—Ohlandt, Greeley, Ruggiero & Perle, L.L.P.

(57) ABSTRACT

A suspension frame for supporting trays includes support rails formed by legs which have cutouts and vertical sections having apertures in order to make it possible to wet the suspension frame with cleaning liquid as far as possible on all sides.

6 Claims, 5 Drawing Sheets

SUSPENSION OR RACK FRAME FOR APPARATUS FOR THE HEAT TREATMENT OF SUBSTANCES, ESPECIALLY FOODSTUFFS

BACKGROUND OF THE INVENTION

1. Field of the Invention

The invention relates to a suspension or rack frame for apparatus for the thermal treatment of substances, especially foodstuffs, having support rails with legs lying one above another for the edge regions of containers or the like.

2. Description of the Related Art

Suspension frames or rack frames of conventional type have support rails which are either fixed to two vertical profiles, the support rails being U-shaped in cross section, or appropriate horizontal legs are punched out from a sheet metal part and angled over so that they act in a way corresponding to the legs of U-shaped rails. This sheet metal part is turned over at the side edges in order to be able to be fixed to a side wall of the cooking appliance, just like the vertical profiles.

In these known embodiments, residues from the cooking operation in the form of organic materials are deposited on the support rails and, at the operating temperature of these apparatuses for the heat treatment of foodstuffs, referred to below as cooking appliances, tend to burn in and therefore adhere firmly to the surfaces. However, the surfaces in a cooking chamber must be satisfactorily clean in accordance with hygiene regulations. During the cleaning of the inner surfaces of cooking appliances, in particular in the interspaces between the containers carried by the support rails and the support rails of the suspension frames or rack frames, problems arise, since dirt and encrustations accumulate there and can be removed only by means of expensive manual labor. This problem is all the more important if account is taken of the fact that in large kitchen appliances, automatic washing devices for the cooking chamber are used. However, even such automatic washing devices cannot solve the problem, since the mechanical action of fast-flowing water jets and the chemical action of the cleaning agents used cannot remove the adhering residues in the aforementioned interspaces either, since the washing liquid does not get to all the points on these support rails, in particular not at those points which lie in what is known as the spray shadow of the water jets. The spraying apparatuses, which emit appropriate water jets, are often located in the upper region of the cooking appliances, so that the undersides of the support rails lie in the aforementioned spray shadow and are not reached by the water jets.

SUMMARY OF THE INVENTION

In the case of a suspension frame or rack frame, it is an object of the invention to configure the support rails in such a way that the washing liquid can get to all points, which improves the cleaning action.

In the case of a suspension frame or rack frame of the type specified further above, this object is achieved, according to the invention, by the support rails being configured by means of cutouts, holes, apertures or the like in the manner of a grid, in the manner of a network or in the manner of a skeleton and being wettable on all sides.

The aforementioned wettability relates to the wetting of all the surfaces of the suspension frame or rack frame by the washing liquid, which can flow through the entire suspension frame or rack frame in the area of the support rail and therefore wets all the points of the suspension frame or rack frame, as a result of which adhering residues from the cooking operation can be detached and flushed away. The inventive configuration of the support rails provides even smaller deposition possibilities for residues, so that the cleaning action is already improved for this reason. Build-up zones, such as occur in the case of the conventional support rails, are avoided in this way.

In order to permit the best possible flushing of the entire suspension frame or rack frame, in a further refinement of the invention provision is made for the cutouts, holes, apertures or the like to be provided both in the legs which serve to support the containers and in the vertical sections located between the legs.

A further improvement in the ability to wet the suspension frame or rack frame on all sides if possible is achieved by cutouts, holes, apertures or the like lying one above another in each case being offset with respect to one another, so that the cleaning liquid flowing from top to bottom in the suspension or rack frame is, if possible, deflected to all sides, in order in this way to reach the parts of the support rails necessary to support the containers.

A further measure to make it possible to spray the cleaning fluid as far as possible everywhere consists in the respective upper legs of the support rails having a smaller extent transverse to the insertion direction than the respective lower legs. In this way, the dead space underneath the upper leg of the support rail is reduced in the case of water jets set obliquely from above.

An advantageous further refinement of the invention consists in at least one of the two legs of a support rail having an angle with respect to the vertical that differs from 90°. It is therefore possible for the upper leg to be inclined obliquely upward or obliquely downward, differing from the usual 90° setting. However, it may also be advantageous to set the lower leg either obliquely upward or obliquely downward, and these measures can also be combined with one another, depending on the directions from which the water jets for cleaning the suspension or rack frame strike the latter.

In the case of inclined legs, it is recommended to profile the surface, in order to avoid the cleaning liquid flowing away too quickly.

If, in further refinement of the invention, all the edges of the support rails are rounded, then the entire cleaning liquid is prevented from dripping off, since this cleaning liquid flows around the rounded edges to the underside of the support rail owing to adhesion forces, by which means the cleaning action is further improved.

The invention may be refined by forming the legs of the support rail as wire hoops. In this way, not only is the support area for the containers and therefore the area for residues to accumulate avoided, but the washing liquid can flow around all sides of the wire hoops, owing to their circular cross section, irrespective of the inflow direction. The same advantages are achieved in a further advantageous refinement which consists in the legs of the support rails being formed by wire grids.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
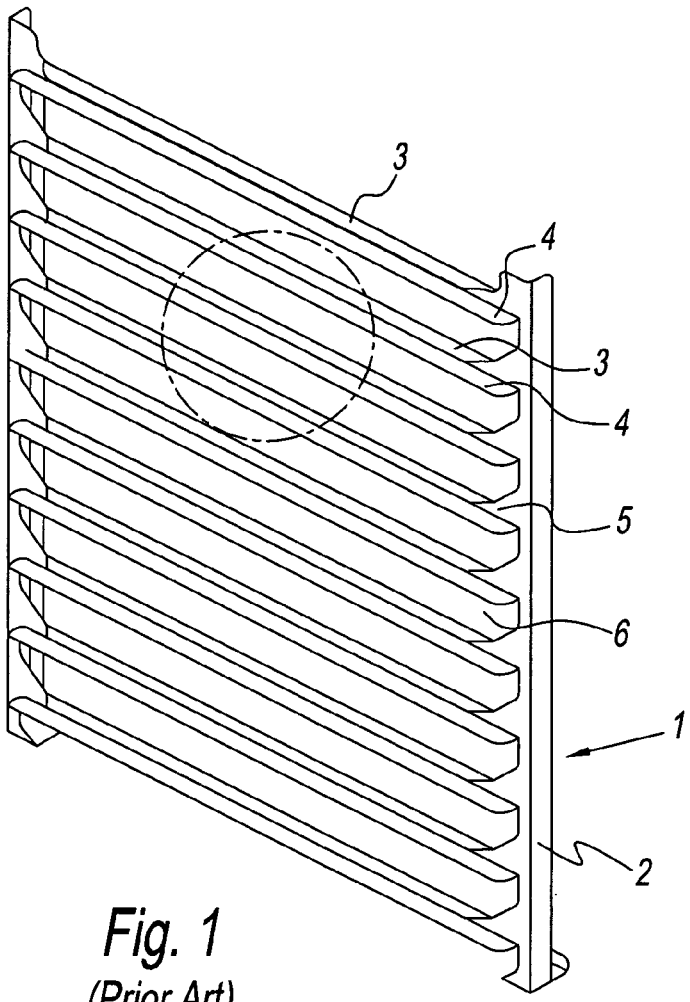
Fig. 1 (Prior Art)
FIG. 1 is a perspective view of a suspension frame according to the prior art.
Figure 1A:
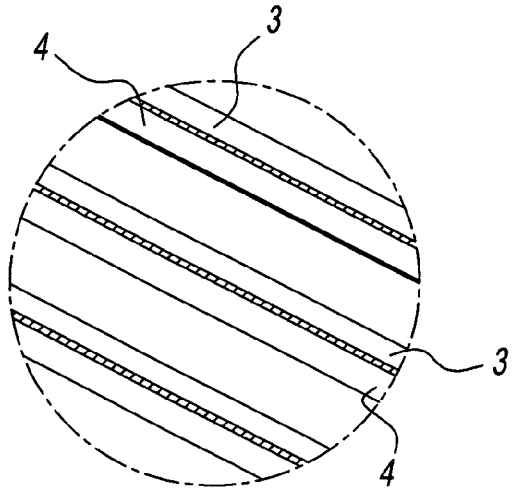
FIG. 1*a* is an enlarged detail from FIG. 1.

As can be seen from FIGS. 1 and 1*a*, a conventional suspension frame 1 comprises a sheet metal part which is provided at the lateral edges with turned-over edges 2 which have means, not specifically illustrated, for fixing to a side wall of a cooking appliance. From this sheet metal part, individual legs 3 and 4 are formed by being punched out and turned over, in each case the legs 3 and 4 forming a support rail, two of which accommodate the edge of a container between them. The physical association between the respective legs 3 and 4 of a support rail can be seen still more clearly from the side view in FIG. 4. In the case of the embodiment according to FIG. 1, these legs are arranged at right angles to the vertical and form continuous sheet metal strips, on which residues can easily collect and burn. The vertical sections 5 between the legs are formed by the sheet metal panel which remains after forming the legs 3, 4. The apertures 6 in the sheet metal part are produced by stamping out the legs 3 and 4 of adjacent rails and turning over their edges. If, in the case of such a known suspension frame, a spraying apparatus is inserted into the cooking chamber in order to spray washing liquid, then it can easily be seen that this spraying liquid, if it is emitted at the top, for example, cannot or can only insufficiently get to the underside of the respective legs 3 and 4 of the support rail.

In the case of the following embodiments of FIGS. 2 to 6, various measures have been taken in order to ensure accessibility of the cleaning liquid to all the points on the support rails.

Figure 2:
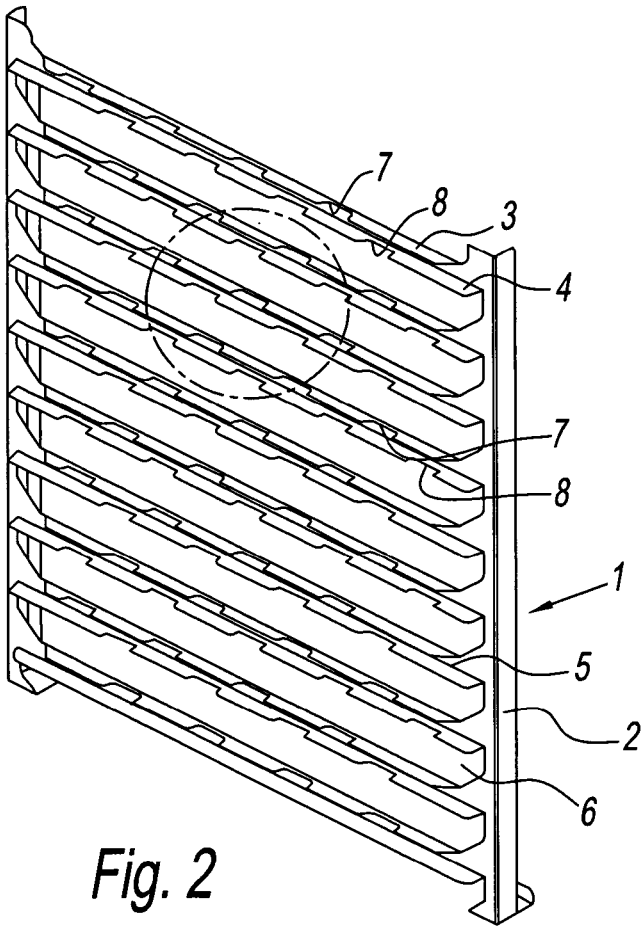
FIG. 2 is a perspective view of a first embodiment of a suspension frame according to the invention.
Figure 2A:
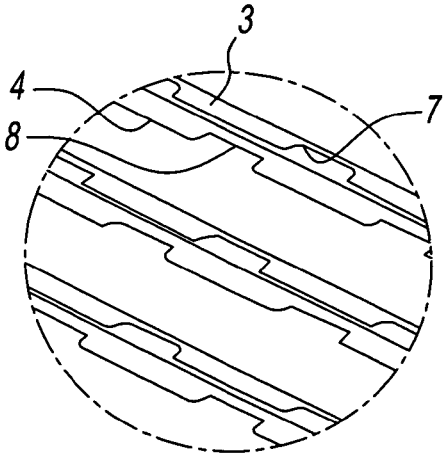
FIG. 2*a* is an enlarged detail from FIG. 2.

In the embodiment according to FIG. 2, the individual legs 3 and 4 of a support rail are provided with cutouts 7 and 8 which are offset with respect to one another, so that a full section of the lower leg 4 lies under a cutout 7 from the upper leg 3, so that the cleaning liquid flowing from top to bottom at the location of the cutout 7 passes downward onto the remaining part of the leg 4 located below and, from there, is distributed on both sides to the respective cutouts 8 of this leg. From these cutouts 8, the cleaning liquid again passes onto the upper leg of the support rail located underneath, and so on. The edges of the legs are all rounded, so that the cleaning liquid which, for example, flows through at a recess 7, reaches the underside of the leg as a result of adhesion force at the edges of this cutout, so that the cleaning liquid wets all the points on both legs 3 and 4 of a support rail.

Figure 3:
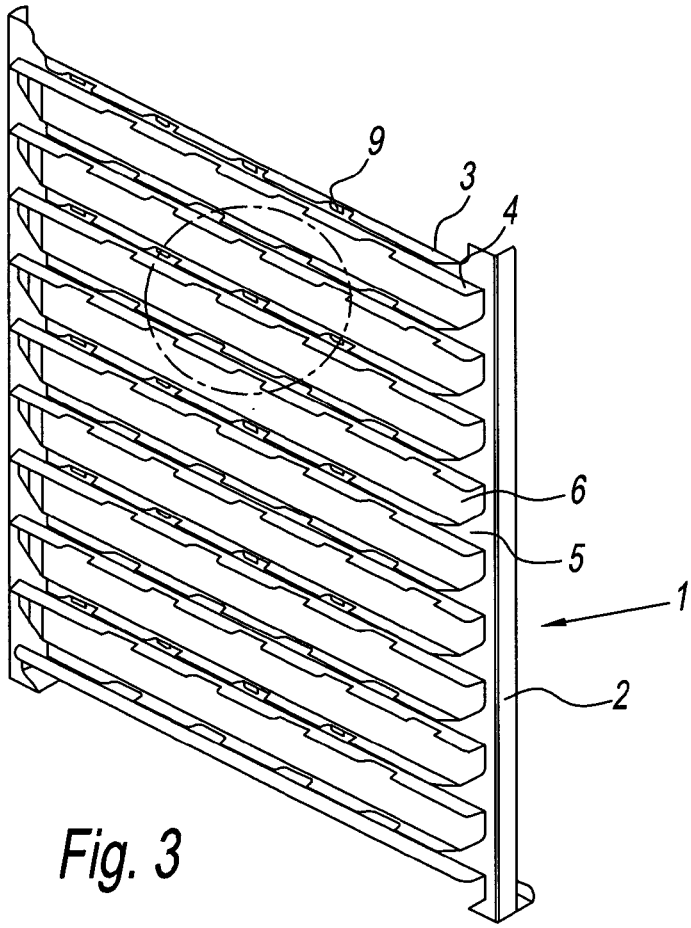
FIG. 3 is a perspective view of a further exemplary embodiment of a support frame.
Figure 3A:
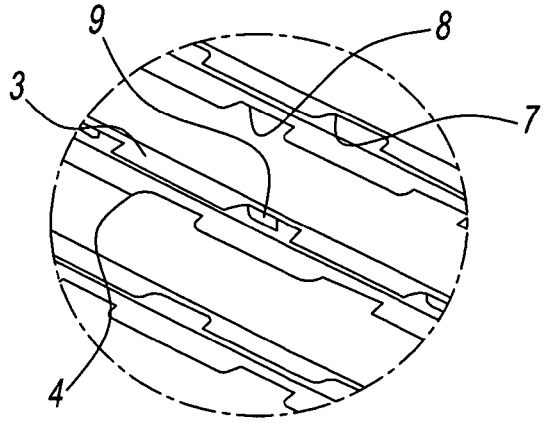
FIG. 3*a* is an enlarged detail from FIG. 3.

In the embodiment according to FIG. 3, in addition to the cutouts 7 and 8 in the legs 3 and 4, openings 9 are formed in the vertical sections 5 between the upper leg 3 and the lower leg 4 of a support rail. This makes it possible for the cleaning liquid backed up by the remaining parts of the lower leg 4 to get through these holes 9 to the rear side of the vertical section 5 and it can therefore also flow down the rear side of the suspension frame. The rear side of the suspension frame is therefore also wetted by the cleaning fluid and thus cleaned.

Figure 4:
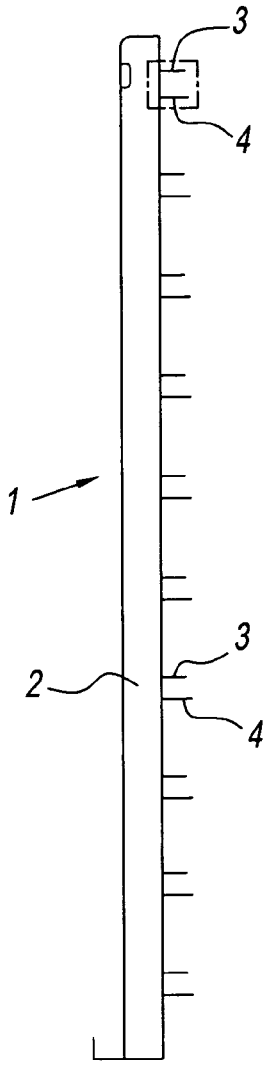
FIG. 4 is a side view of a suspension frame.
Figure 4A:
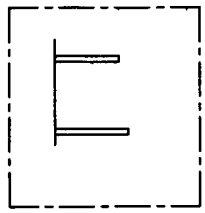
FIGS. 4*a*–4*e* are side views of various configurations of the support rails of the suspension frame according to FIG. 4.
Figure 4B:
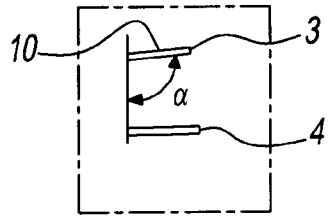
Figure 4C:
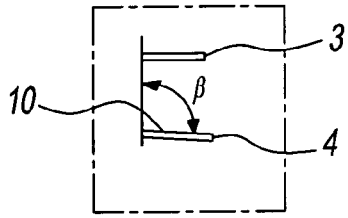
Figure 4D:
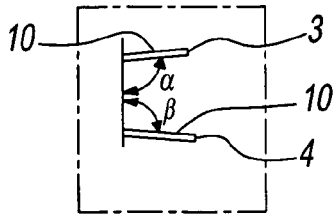
Figure 4E:
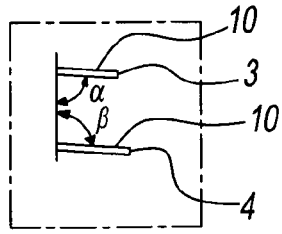

In the configuration according to FIG. 4, it can be seen that the upper leg 3 has a shorter extent in the lateral direction than the lower leg 4, as a result of which the dead space on the underside of the upper leg 3 is reduced. This can be seen in particular in FIG. 4*a*. The further variations show different setting angles of the respective legs. While in the configuration according to FIG. 4*a*, the legs 3 and 4 are at right angles to the vertical, the legs 3 in FIG. 4*b* have an angle $\alpha$ to the vertical which is greater than 90°. In this case, the leg 4 is arranged at right angles to the vertical. In the configuration according to FIG. 4*c*, the upper leg 3 is arranged at right angles to the vertical, while the lower leg 4 is inclined obliquely downward. This angle is designated by $\beta$ and is somewhat greater than 90°. In the configuration according to FIG. 4*d*, the upper leg 3 is inclined obliquely upward and the lower leg 4 is inclined obliquely downward. In the configuration according to FIG. 4*e*, both legs 3 and 4 are respectively inclined obliquely downward.

The respectively inclined legs are provided with a surface profile 10 by means of an appropriate embossing operation, so that the cleaning liquid cannot flow away as quickly as would be the case with a smooth surface, on account of the inclination of the leg.

Figure 5:
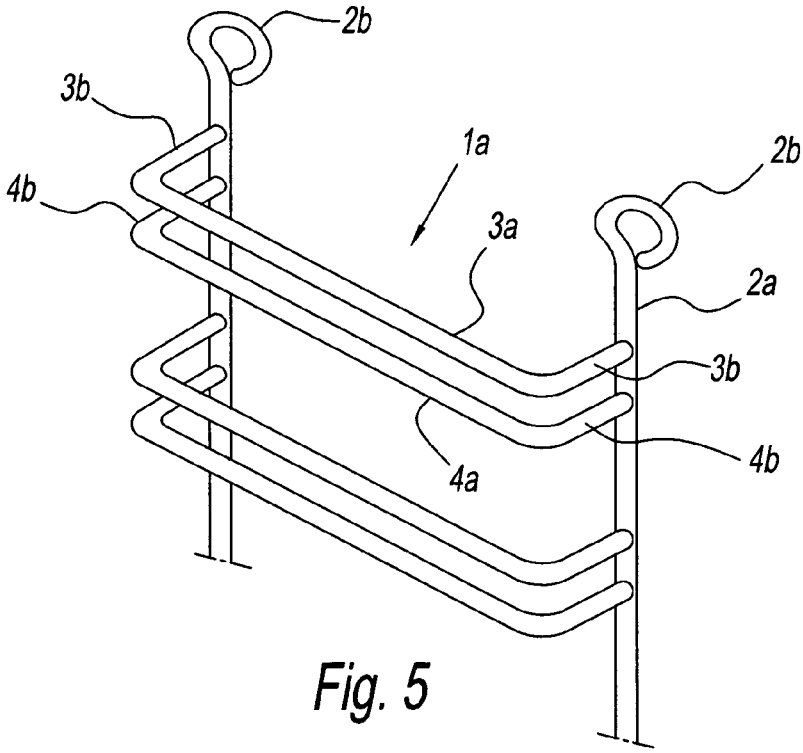
FIG. 5 is a perspective view of a further embodiment of a suspension frame.

In the embodiment according to FIG. 5, the suspension frame designated by 1*a* is built up from wires, in each case two vertical rods 2*a* with suspension eyes 2*b* being provided at the side edges, with which eyes the suspension frame 1*a* can be suspended on appropriate hooks on the side wall of a cooking appliance. The support rails are formed by wire hoops 3*a* and 4*a*, which are fixed to the respective vertical rods 2*a* by their angled-over ends 3*b* and 4*b*. This embodiment provides extremely small areas of attack on which residues can adhere.

Figure 6:
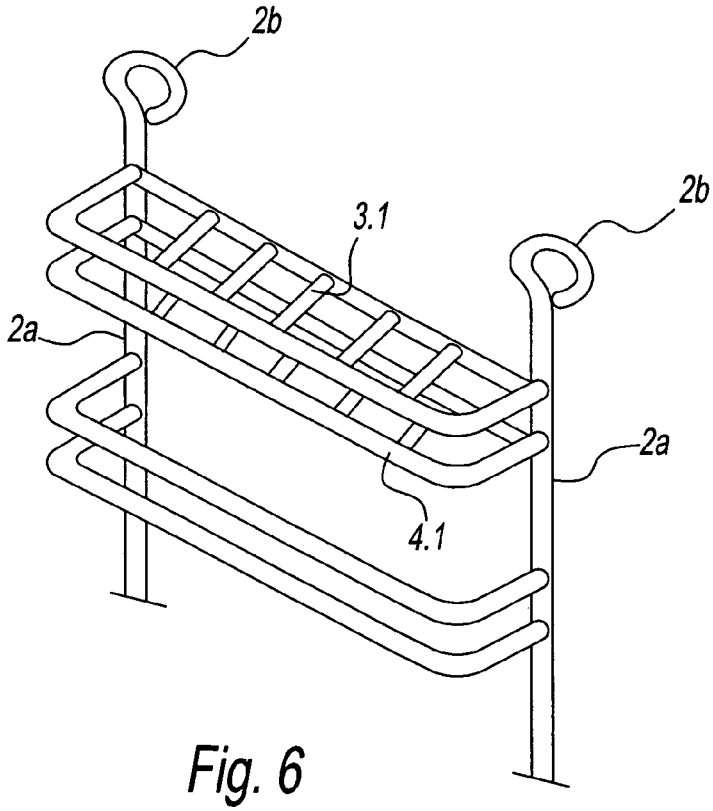
FIG. 6 is a perspective view of a further embodiment of a suspension frame.

The variant according to FIG. 6 shows support rails having legs 3.1 and 4.1 made of wire grids.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A frame for supporting trays of material during heat treatment, said frame comprising a plurality of substantially horizontal rails, wherein each said rail comprises pair of laterally extending upper and lower legs spaced to receive an edge region of one of said trays, and a vertical base section disposed between said legs, a plurality of apertures disposed in said vertical base section, a plurality of upper cutouts and lower cutouts disposed in said upper and lower legs, respectively, wherein said upper cutouts are offset from said lower cutouts so as to be above underlying lateral portions of said lower legs between said lower cutouts so that cleaning liquid flowing vertically at a location of any one of said upper cutouts passes downward onto the corresponding underlying portion of the lower leg and is distributed along the corresponding underlying portion to the adjacent lower cutouts so that all surfaces of the frame are wettable by said cleaning liquid.

2. A frame as in claim 1, wherein each said lower leg in each said pair extends laterally further than the upper leg.

3. A frame as in claim 1, wherein at least one leg in each said pair has a non-perpendicular angle with respect to vertical.

4. A frame as in claim 3, wherein said at least one leg in each pair has a profiled surface.

5. A frame as in claim 1, wherein each said support rail is defined by edges, all of said edges being rounded.

6. A frame as in claim 1, wherein said frame is a suspension frame.

* * * * *